US005819391A

United States Patent [19]

Matsushima et al.

[11] Patent Number: 5,819,391

[45] Date of Patent: Oct. 13, 1998

[54] SURFACE FASTENER AND METHOD OF MANUFACTURING THE SAME

[75] Inventors: Hideyuki Matsushima; Hitomi Minato, both of Toyama-ken, Japan

[73] Assignee: YKK Corporation, Tokyo, Japan

[21] Appl. No.: 703,868

[22] Filed: Aug. 27, 1996

[30] Foreign Application Priority Data

Aug. 30, 1995 [JP] Japan ..... 7-221602

[51] Int. Cl.[6] ..... A44B 18/00; A44B 13/00

[52] U.S. Cl. ..... 24/452; 24/442

[58] Field of Search ..... 24/306, 442–452, 24/575–577

[56] References Cited

U.S. PATENT DOCUMENTS

| | | | |
|---|---|---|---|
| 3,607,995 | 9/1971 | Chiba | 264/322 X |
| 3,879,835 | 4/1975 | Brumlik | 29/412 |
| 3,899,803 | 8/1975 | Brumlik | 24/442 |
| 4,216,257 | 8/1980 | Schams et al. | 428/93 |
| 4,654,246 | 3/1987 | Provost et al. | 428/100 X |
| 4,707,893 | 11/1987 | Hashizume et al. | 24/450 X |
| 4,776,068 | 10/1988 | Smirlock et al. | 24/442 |
| 4,973,326 | 11/1990 | Wood et al. | 24/450 X |
| 5,212,853 | 5/1993 | Kaneko | 24/452 |
| 5,326,612 | 7/1994 | Goulait | 24/452 X |
| 5,429,875 | 7/1995 | Okamoto et al. | 24/443 X |
| 5,554,239 | 9/1996 | Datta et al. | 24/442 X |

FOREIGN PATENT DOCUMENTS

| | | | |
|---|---|---|---|
| 264770 | 9/1968 | Australia | 24/452 |
| 0 325 473 | 1/1988 | European Pat. Off. . | |
| 0 691 090 | 1/1996 | European Pat. Off. . | |
| 7-39407 | 2/1995 | Japan . | |

*Primary Examiner*—Peter M. Cuomo
*Assistant Examiner*—Robert J. Sandy
*Attorney, Agent, or Firm*—Hill, Steadman & Simpson

[57] ABSTRACT

A surface fastener comprising: a substrate sheet; a multiplicity of engaging elements projecting from on surface of the substrate sheet; and an elastic member laying over the one surface of the substrate sheet. The elastic member has an upper surface normally in contact with lower ends of locking portions of the engaging elements so as to support circumferential surfaces of stem portions of the engaging elements. The upper surface of the surface fastener is therefore less rough so that waste pieces of yarn and nap cannot be caught by the locking portions.

8 Claims, 6 Drawing Sheets

SURFACE FASTENER AND METHOD OF MANUFACTURING THE SAME

BACKGROUND OF THE INVENTION

1. Field of the Invention

This invention relates to a surface fastener of thermoplastic synthetic resin, in which a multiplicity of engaging elements are integrally molded on a surface of a substrate sheet, and a method of manufacturing the surface fastener. More particularly, the invention relates to a molded surface fastener, in which locking portions of engaging elements are free from catching foreign objects, such as nap, waste pieces of yarn and dust, by accident, and a method of manufacturing the molded surface fastener.

2. Description of the Related Art

As an attempt to eliminate a disagreeable rough touch on top ends of engaging elements of a molded surface fastener, Japanese Patent Laid-Open Publication No. Hei 5-285008 discloses a surface fastener molded of synthetic resin in which a shock absorbing sheet softer than the engaging elements and compression-deformable is placed around the individual engaging elements in such a manner that its upper surface is higher in level than top ends of the individual engaging elements. As another measure, Japanese Utility Model Publication No. Hei 6-37710 discloses a surface fastener in which a foam member is disposed between male engaging elements in such a manner that its upper surface is higher in level than the male engaging elements to secure precise positioning of the male engaging elements with respect to engaging elements of a companion surface fastener, preventing the male engaging elements from falling flat. Further, Japanese Patent Laid-Open Publication No. Hei 7-39407 discloses a concept of disposing around engaging elements on a substrate sheet a shock absorbing material, as of sponge, having a height 50–90% of stem portions of the engaging elements in order to reduce possible frictional sound that might occur when companion surface fasteners having mushroom-shaped engaging elements of synthetic resin are coupled together.

However, the surface fastener disclosed in Japanese Patent Laid-Open Publication No. Hei 5-285008, of which an abstract disclosure of a manufacturing method is given, does not guarantee that the locking portions of the engaging elements project outwardly from the upper surface of the shock absorbing material in the form of a non-woven cloth so as to engage with mating loop elements reliably at the time of engagement with the companion surface fastener. The whole of the engaging elements tend to be covered by the non-woven cloth, which could not be avoided without making the manufacturing process complex. It is also the case with the surface fastener disclosed in Japanese Utility Model Publication No. Hei 6-37710. On the other hand, Japanese Patent Laid-Open Publication No. Hei 7-39407 discloses nothing about the industrial technique of disposing a shock absorbing material around engaging elements. And it is difficult to secure productivity in manufacturing surface fasteners with minute engaging elements unless special technique is used.

Generally, the common problem with the male surface fastener members is that the individual engaging heads tend to catch or hook a garment by accident and hence to give it a damage. According to the surface fastener disclosed in Japanese Patent Laid-Open Publication No. Hei 5-285008 and Japanese Utility Model Publication No. Hei 6-37710, although the engaging elements are free from catching a garment by accident, dust tend to stay in pockets defined around the engaging elements by the shock absorbing material or the foamed member so that smooth engagement with the companion surface fastener is difficult to achieve. According to the surface fastener disclosed in Japanese Patent Laid-Open Publication No. Hei 7-39407, since the upper surface of the shock absorbing material is lower in level than the lower surface of each locking portion of the engaging elements, the locking portions tend to catch waste pieces of yarn and nap as well as dust.

SUMMARY OF THE INVENTION

It is therefore an object of this invention to provide a surface fastener which enables an economical production, has a less rough engaging-element-side surface, is hard to catch a garment, waste pieces of yarn and nap as well as dust, and guarantees an adequate degree of shape stability of engaging elements. Another object of the invention is to provide a method of manufacturing the described surface fastener.

In order to accomplish the above object, according to this invention, there is provided a surface fastener comprising: a substrate sheet; a multiplicity of engaging elements projecting from one surface of the substrate sheet; and an elastic member laying over the one surface of the substrate sheet, the elastic member having an upper surface normally in contact with lower ends of locking portions of the engaging elements and the elastic member supporting circumferential surfaces of stem portions of the engaging elements.

Preferably, the substrate sheet and the engaging elements are woven or knitted of fiber yarns and monofilaments, the elastic member being a soft foamed layer of a material non-adhesive to the engaging elements. Alternatively, when the substrate sheet and the engaging elements are integrally molded of thermoplastic resin, the elastic member is a soft formed resin layer and there should be no limitation in adhesiveness.

The above surface fastener is manufactured by a first method comprising the steps of: integrally forming the multiplicity of engaging elements, each having a stem portion and a locking portion projecting from an upper end of the stem portion, on one surface of the substrate sheet; and providing the elastic member on the one surface of the substrate sheet between the engaging elements in intimate contact therewith, in such a manner that an upper surface of the elastic member is normally in contact with a lower end of the locking portion of the individual engaging element.

The above surface fastener is manufactured by a second method comprising the steps of: integrally forming the multiplicity of engaging elements, each having a stem portion and a locking-portion-forming-end at an upper end of the stem portion, on one surface of the substrate sheet; providing the elastic member on the one surface of the substrate sheet between the engaging elements in intimate contact therewith, in such a manner that the locking-portion-forming ends of the engaging elements project outwardly from an upper surface of the elastic member; and deforming the locking-portion-forming-ends of the engaging elements under heat so as to form the locking portions in such a manner that their lower ends are normally in contact with the upper surface of the elastic member.

DETAILED DESCRIPTION OF THE PREFERRED EMBODIMENTS

Figure 1:
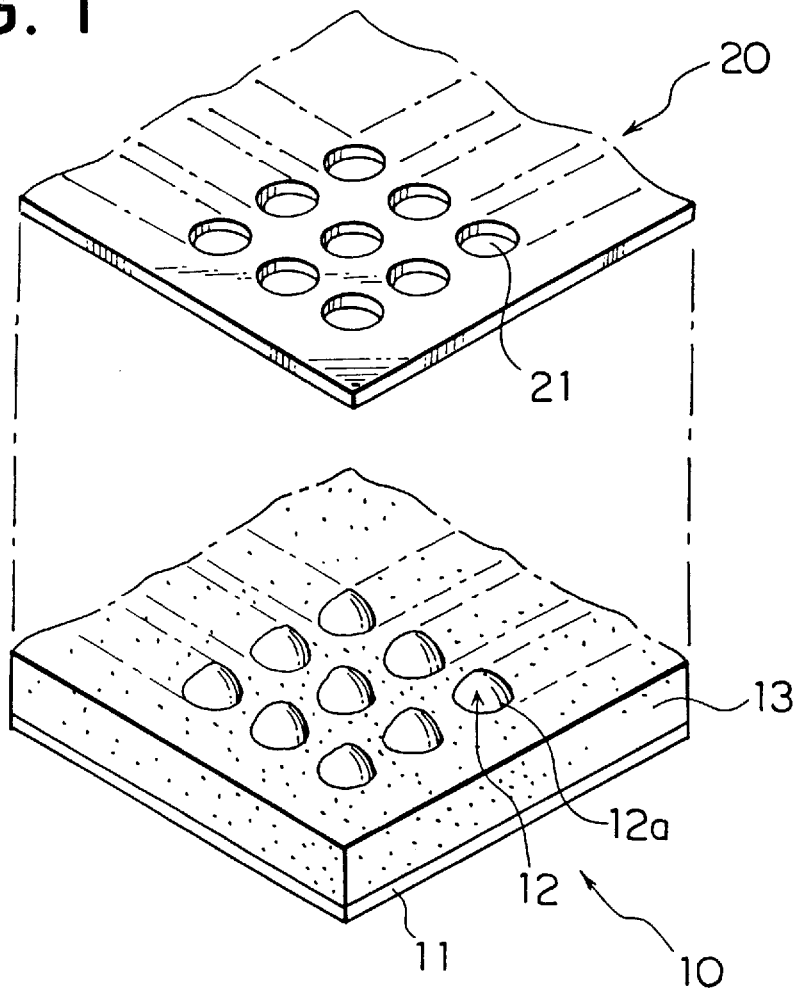
FIG. 1 As a fragmentary perspective view showing a molded surface fastener according to a first embodiment of this invention and a companion coupling member.

Preferred embodiments of this invention will now be described in detail with reference to the accompanying drawings. FIG. 1 is a fragmentary perspective view showing a male molded surface fastener according to a first embodiment of this invention and a female companion surface fastener.

In FIG. 1, reference numeral 10 designates a male molded surface fastener which comprises a substrate sheet 11, a multiplicity of mushroom-shaped male engaging elements 12, and an elastic layer 13 of sponge. The substrate sheet 11 and the male engaging elements 12 are previously integrally molded as by injection molding. In a first example of manufacturing method, after a multiplicity of column-like projections are integrally molded on one surface of the substrate sheet 11, the column-like projections, together with the substrate sheet 11, except their upper end portions of a predetermined length are soaked in water, whereupon the upper end portions projecting above the water surface is deformed, under heat, each into a hemispheric engaging head 12*a*. Alternatively the male engaging elements 12 having the hemispheric engaging heads 12*a* may be formed by injection molding. The material of the substrate sheet 11 and the male engaging elements 12 is exemplified by polyamide resin, polyester resin and polypropylene resin.

The molded surface fastener 10 of this invention has the elastic layer 13 of polyurethane foamed material laying over the surface of the substrate sheet 11 around the stem portions 12*b* of the individual male engaging elements 12. The upper surface of the elastic layer 13 is higher than the lower surface of the engaging head 12*a* of the individual male engaging element 12 and swells outwardly to a middle position of the engaging head 12*a*, as shown in FIG. 2B. Thus the upper half part of each engaging head 12*a* projects above the upper surface of the elastic layer 13, while the remaining part of the male engaging element 12 are fully surrounded by the elastic layer 13. The elastic layer 13 may be made of polyurethane resin or other elastic foamed resin.

The elastic layer 13 is formed on the surface of the substrate sheet 11 preferably in the following two methods. However this invention should by no means be limited to these illustrated examples.

Figure 11A:
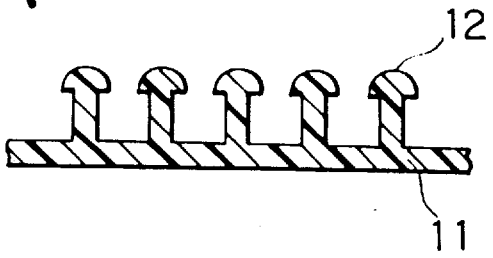
FIGS. 11A, 11B and 11C show the manner in which the molded surface fastener is progressively manufactured in a first method of the invention.
Figure 11B:
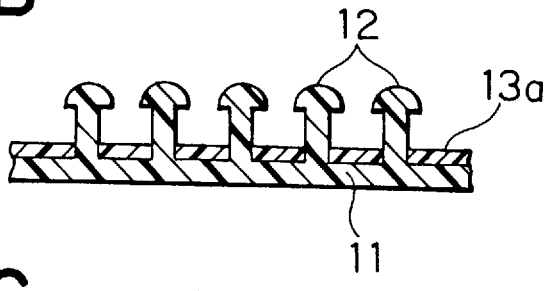
Figure 11C:
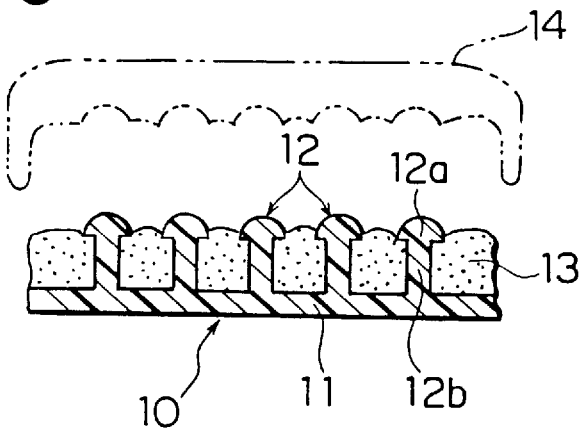

FIGS. 11A, 11B and 11C show the forming procedure of the elastic layer 13 according to a first method. The first method comprises the steps of previously molding the substrate sheet 11 having on one surface the multiplicity of engaging elements 12 (FIG. 11A), applying or ink-jet spraying over the surface of the substrate sheet 11 around the engaging elements 12 a predetermined quantity of foam undiluted solution 13*a*, such as diisocyanate containing various additives, diluted by a volatile solvent (FIG. 11B), and heating the sprayed surface of the substrate sheet 11 to cause the foam undiluted solution 13*a* to foam after the solvent volatilizes (FIG. 11C). If the extent to which the foam material is to be expanded in volume by foaming is previously known, the elastic layer 13 may be formed by foaming freely; usually, however, it is foamed, under heat, within a molding die 14 (indicated by a phantom line in FIG. 11C restricting the foaming. If a foam resin material which foams at the normal temperature is used, it may be simply poured into the molding die 14 for foaming inside.

Figure 12A:
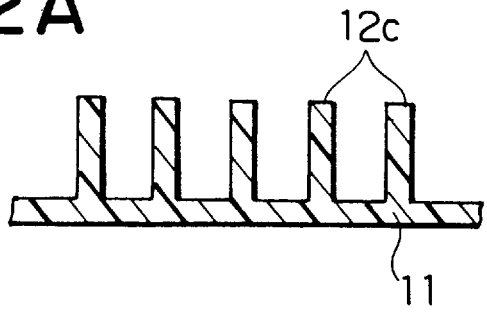
FIGS. 12A, 12B and 12C show the manner in which the molded surface fastener is progressively manufactured in a second method of the invention.
Figure 12B:
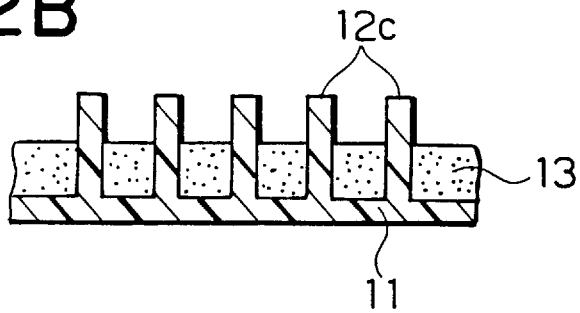
Figure 12C:
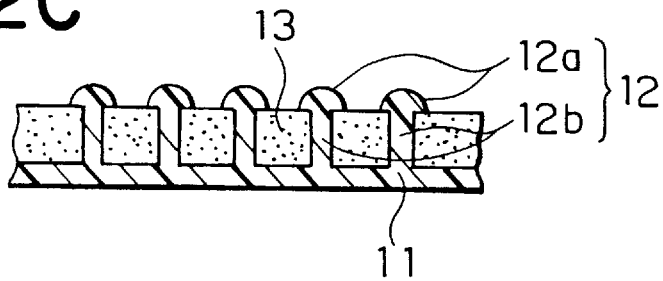

FIGS. 12A, 12B and 12C show the forming procedure of the elastic layer 13 and the engaging heads 12*a* of the engaging elements 12 according to a second method. The second method comprises the steps of previously molding a multiplicity of column-like projections 12*c* integrally on one surface of a substrate sheet 11 (FIG. 12A), and forming the elastic layer 13 of a predetermined height or thickness on the surface of the substrate sheet 13 around the column-like projections 12*c* (FIG. 12B). At that time, a predetermined-length upper part of each column-like projection 12*c* is exposed from the upper surface of the elastic layer 13. For the elastic layer 13, a foamed resin more elastic than the column-like projections 12*c* and having a higher melting point is selected. The elastic layer 13 is formed likewise the above-mentioned first method. After this forming of the elastic layer 13, the upper ends of the column-like projections 12*c* exposed from the elastic layer 13 are heated to melt by touching a non-illustrated heating plate so that the hemispheric engaging head 12*a* is formed on the upper end of each column-like projection 12*c*. At that time, this deformation is continued until the lower surface of the hemispheric engaging head 12*a* comes into contact with or slightly penetrates into the upper surface of the elastic layer 13 as shown in FIG. 12C.

In the thus manufactured molded surface fastener 10, only the upper surface of the engaging head 12*a* of each engaging element 12 is exposed on the upper surface of the elastic layer 13, while the stem portion 12*b* and the lower surface of the engaging head 12*a* are embedded in the elastic layer 13. Accordingly the stem portion 12*b* of each engaging element 12 is supported through its entire length by the elastic layer 13 so that its shape is stable during engagement with the companion coupling member and is free from catching a garment, waste pieces of yarn, nap, dust, etc. while it is not in engagement and exposed to the outside.

Figure 2A:
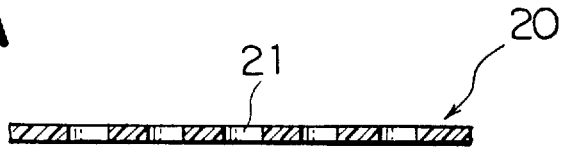
FIG. 2A is a fragmentary cross-sectional view showing the companion coupling member of FIG. 1.
Figure 2B:
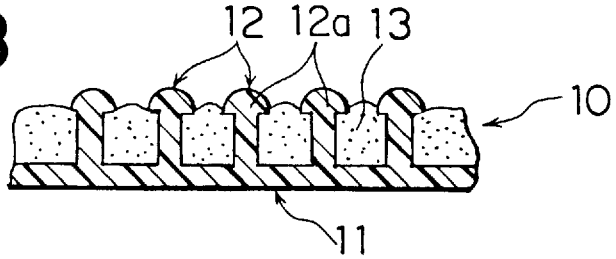
FIG. 2B, is a fragmentary cross-sectional view showing the molded surface fastener of FIG. 1.
Figure 3:
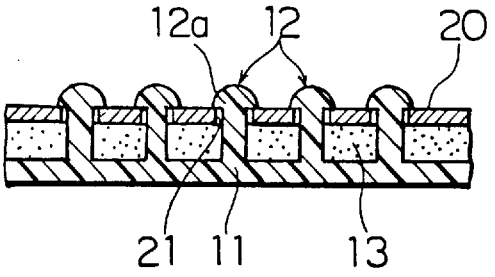
FIG. 3 is a fragmentary cross-sectional view showing the molded surface fastener and the companion coupling member in coupled form.
Figure 4:
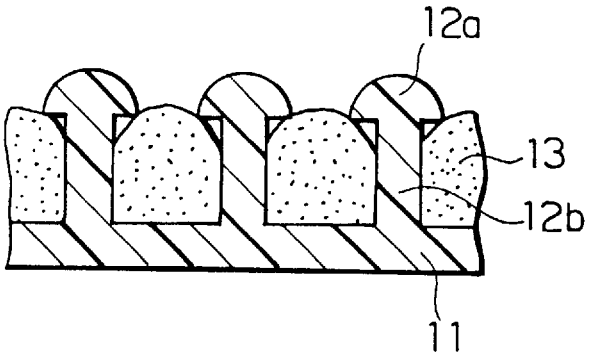
FIG. 4 is a fragmentary cross-sectional view showing a modified form of an elastic layer of the molded surface fastener of the first embodiment.

FIGS. 2A, 2B and 3 schematically show the manner in which the molded surface fastener 10 comes into engagement with a companion female engaging member 20. The female engaging member 20 is in the form of a flat plate having a multiplicity of engaging holes 21. As the female engaging member 20 is pressed against the engaging heads 12*a* of the engaging elements 12 of the molded surface fastener 10, the engaging heads 12*a* slightly deform and is then inserted through the engaging holes 21. Simultaneously, the elastic layer 13 elastically deforms downwardly between the individual engaging elements 12 to allow the female engaging member 20 to move downwardly.

The deformation of the elastic layer 13 may be facilitated by selecting, as the material of the elastic layer 13, a non-adhesive material non-adhesive with respect to the material of the substrate sheet 11 and the engaging elements 12. Assuming that the molded surface fastener is used as, a fastener for fastening interior materials inside a car or a house so that peeling and coupling does not take place repeatedly, the elastic layer 13 is not necessarily non-adhesive with respect to the substrate sheet 11 and the engaging elements 12. Alternatively, foaming of the elastic layer 13 may be terminated when part of the elastic layer 13 comes into contact with only the peripheral edge of the lower surface of the individual engaging head 12*a*, namely, before touching the whole lower surface of the individual engaging head 12*a*, so that the molded surface fastener 10 can be coupled with the female engaging member 20 even when pressed by a relatively small force.

Figure 5:
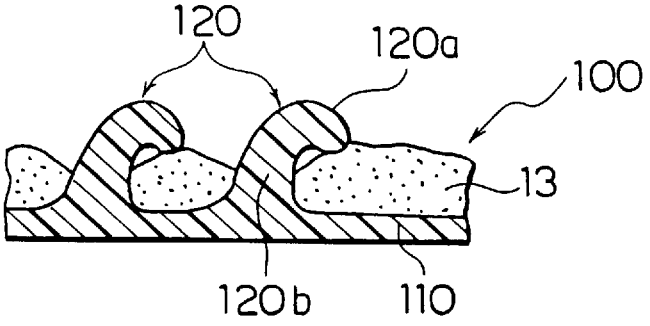
FIG. 5 is a fragmentary cross-sectional view showing a molded surface fastener according to a second embodiment of the invention.
Figure 6:
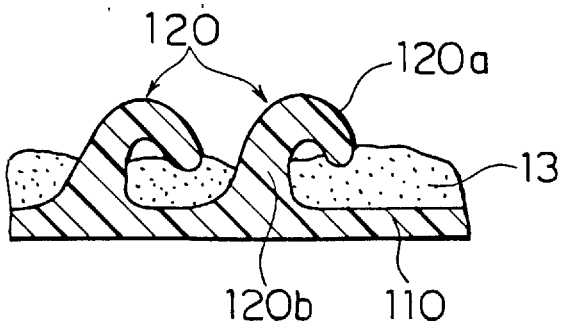
FIG. 6 is a fragmentary cross-sectional view showing a modified form of the elastic layer of the molded surface fastener of the second embodiment.

FIGS. 5 and 6 show a molded surface fastener 100 according to a second embodiment in which hook-shaped engaging elements 120 are substituted for the mushroom-shaped engaging elements 12 of the first embodiment. Also in the molded surface fastener 100, the whole lower surface of a curved locking portion 120*a* of each hook-shaped engaging element 120 is normally in contact with the upper surface of the elastic layer 13, or the tip of the curved locking portion 120*a* is normally in contact with or slightly penetrates into the upper surface of the elastic layer 13, as shown in FIGS. 5 and 6. In the case of that the elastic layer 13 is formed to be in contact with the lower surface of the tip of the curved locking portion 120*a*, as shown in FIG. 5, the surface fastener 100 can be engaged with the companion female engaging member by a relatively small pressing force, as compared to the case of FIG. 6 in which the tip of the curved locking portion 120*a* is slightly embedded.

Figure 7:
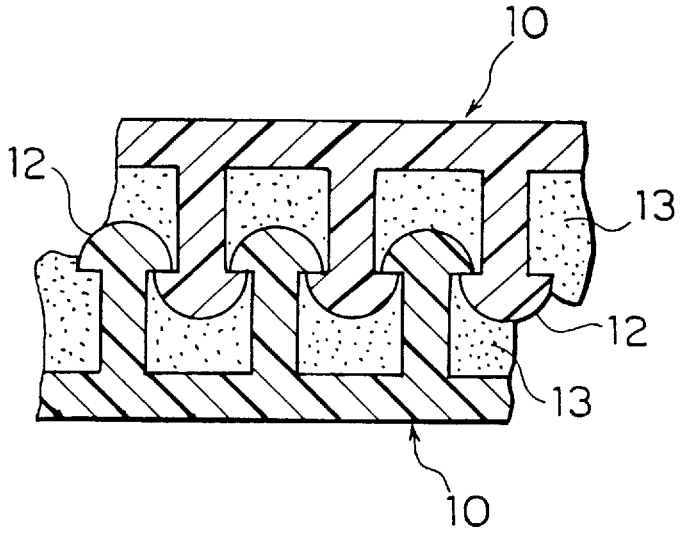
FIG. 7 is a fragmentary cross-sectional view showing the molded surface fastener of the first embodiment as coupled with an identical companion surface fastener.
Figure 8:
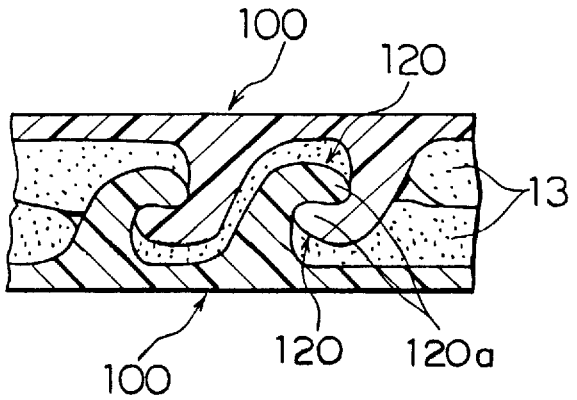
FIG. 8 a fragmentary cross-sectional view showing the molded surface fastener of the second embodiment as coupled with an identical companion surface fastener.
Figure 9:
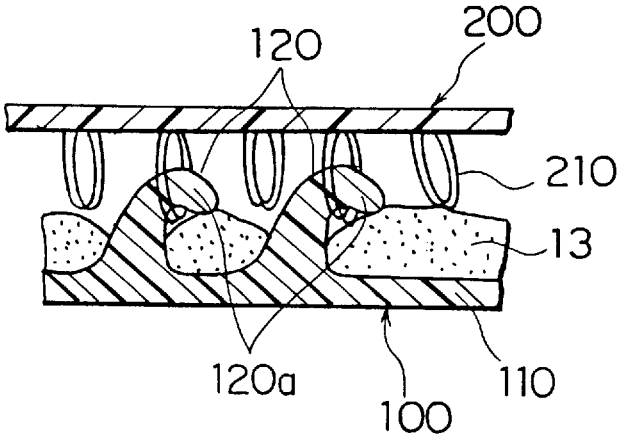
FIG. 9 is a fragmentary cross-sectional view showing the molded surface fastener of the second embodiment as coupled with an ordinary female surface fastener having loops.

FIGS. 7 through 9 show examples of companion engaging members to be coupled with the molded surface fastener 10, 100 molded as above and their manners of engagement. In the example of FIG. 7, the surface fastener 10 has the multiplicity of mushroom-shaped engaging elements 12 of the first embodiment, and the companion engaging element has the same structure as that of the surface fastener 10. In the example of FIG. 8, either the male engaging member and the female engaging member is the molded surface fastener 10 of the first embodiment. In the example of FIG. 8, adjacent curved locking portions 120*a* are urged in the engaging directions due to the elasticity of the elastic layer 13 as compressed to deform by the hook-shaped engaging elements 120, causing an improved degree of engaging force. In the example of FIG. 9, the male engaging member is the molded surface fastener 100 having the above-described hook-shaped engaging elements 120, while the companion female engaging member is a female surface fastener 200 having loops 210. In this example, in order to increase the rate of engagement with the female surface fastener 200, it is preferable that the tip of the curved locking portion 120*a* of each hook-shaped engaging element 120 is normally in slight contact with the upper surface of the elastic layer 13 and that the elastic layer 13 is made of a non-adhesive material non-adhesive with respect to a substrate sheet 110 and the engaging elements 120.

Figure 10:
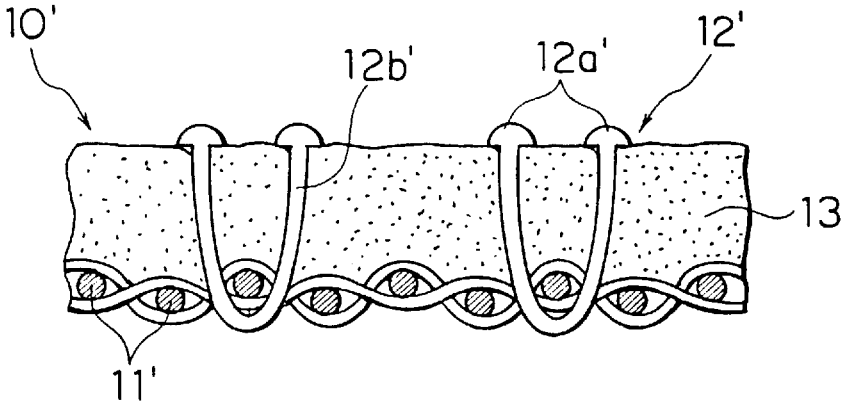
FIG. 10 is a fragmentary cross-sectional view showing a surface fastener of fibers according to a third embodiment of the invention.

FIG. 10 shows a third embodiment in which the molded surface fastener 10, 100 of each of the foregoing embodiments is substituted by a surface fastener 10' woven or knitted of fiber threads or monofilaments. In the third embodiment, engaging elements 12' are made of a monofilament; firstly, the monofilament is woven or knitted in loops in a woven or knit foundation structure during the weaving or knitting of the foundation structure, whereupon upper ends of the individual loops are cut off and then each upper end is deformed into a hemispheric engaging head 12*a*'. The engaging head 12*a'* may be formed in an alternative known method.

As is apparent from the foregoing description, the surface fastener 10, 100 of this invention is easy to manufacture. Further, partly since the stem portion 12*b*, 12*b*', 120*b* of the individual engaging element 12, 12', 120 is supported through substantially the entire surface by the elastic layer 13, and partly since the lower surface of the locking portion 12*a*, 12*a*', 120*a* is normally at least in contact with the upper surface of the elastic layer, the engaging elements are adequately stable in shape. Furthermore, since the engaging elements 12, 12', 120 are free from catching waste pieces of yarn, nap, etc. even when the engaging surface of the surface fastener 10, 100 comes into contact with a garment, it is possible to guarantee a neat appearance and an adequate degree of engaging force for a long period of time with repeated use.

What is claimed is:

1. A surface fastener comprising:

(a) a substrate sheet:

(b) a multiplicity of engaging elements projecting from one surface of said substrate sheet, each of said engaging elements having a stem portion extending from said one surface of said substrate sheet and a locking portion extending from said stem portion, said locking portion having a lower surface facing said one surface at a lower end of said locking portion: and (c) an elastic member laying over said one surface of said substrate sheet, said elastic member having an upper surface normally in contact with said lower surface of said lower ends of said locking portions of said engaging elements and said elastic member supporting circumferential surfaces of said stem portions of said engaging elements.

2. A surface fastener according to claim 1, wherein said substrate sheet and said engaging elements are woven or knitted of fiber yarns and monofilaments, said elastic member being a soft foamed layer of a material non-adhesive to the engaging elements.

3. A surface fastener according to claim 1, wherein said substrate sheet and said engaging elements are integrally molded of thermoplastic resin, said elastic member being a soft formed resin layer.

4. A surface fastener according to claim 1, wherein an upper part of the locking portion projects above the upper surface of the elastic member.

5. A surface fastener according to claim 1, wherein the upper surface of the elastic member extends from the lower ends of the locking portions of adjacent engaging elements outwardly beyond the lower ends of the locking portions.

6. A surface fastener according to claim 5, wherein the upper surface of the elastic member extends from the lower ends of the locking portions of adjacent engaging elements outwardly to about a middle area of the locking portions.

7. A surface fastener according to claim 1, wherein each of the engaging elements has a mushroom-like shape.

8. A surface fastener according to claim 1, wherein each of the engaging elements has a hook shape.

* * * * *